US012510253B2

(12) United States Patent
Borbolla Jimenez et al.

(10) Patent No.: US 12,510,253 B2
(45) Date of Patent: Dec. 30, 2025

(54) COOKING PLATE AND A PROCEDURE FOR MOUNTING A COOKING PLATE

(71) Applicant: BSH Hausgeräte GmbH, Munich (DE)

(72) Inventors: Eduardo Borbolla Jimenez, Boo de Piélagos (ES); Roberto Carballo Fernandez, Santander (ES); Alfonso Herrera Ruiz, Maliaño (ES); Carlos Pelayo Alonso, Villafufre (ES)

(73) Assignee: BSH Hausgeräte GmbH, Munich (DE)

( * ) Notice: Subject to any disclaimer, the term of this patent is extended or adjusted under 35 U.S.C. 154(b) by 683 days.

(21) Appl. No.: 17/779,586

(22) PCT Filed: Dec. 3, 2020

(86) PCT No.: PCT/EP2020/084415
§ 371 (c)(1),
(2) Date: May 25, 2022

(87) PCT Pub. No.: WO2021/122027
PCT Pub. Date: Jun. 24, 2021

(65) Prior Publication Data

US 2023/0010723 A1 Jan. 12, 2023

(30) Foreign Application Priority Data

Dec. 19, 2019 (EP) ..... 19383149

(51) Int. Cl.
*F24C 15/10* (2006.01)
*F24C 15/08* (2006.01)

(52) U.S. Cl.
CPC ..... *F24C 15/108* (2013.01); *F24C 15/08* (2013.01)

(58) Field of Classification Search
USPC ..... 126/1 R
See application file for complete search history.

(56) References Cited

U.S. PATENT DOCUMENTS 4,237,856 A * 12/1980 Trombatore ..... F24C 15/12 126/299 C
5,640,947 A * 6/1997 Shute ..... F24C 15/108 126/39 J (Continued)

FOREIGN PATENT DOCUMENTS

DE 102007012481 A1 * 9/2008 ..... F24C 15/10
DE 102012200315 A1 * 7/2013 ..... F24C 15/108

(Continued)

OTHER PUBLICATIONS

Japanese to English machine translation for JPH0972553A.*

(Continued)

*Primary Examiner* — Michael G Hoang
*Assistant Examiner* — Elizabeth Ann Laughlin
(74) *Attorney, Agent, or Firm* — Michael E. Tschupp; Andre Pallapies; Brandon G. Braun

(57) ABSTRACT

A cooking plate mountable into an opening of a resting surface, in particular of a surface of a kitchen worktop, wherein the cooking plate comprises:

a component box for housing functional components of the cooking plate (1), which has a base and side walls, wherein at least one of the side walls is connected to a resting fin that can rest on the resting surface in a mounted state of the cooking plate in the opening, and a positioning device with at least a limiter limiting the minimum distance from the wall to an opening edge in the mounted state of the cooking plate in the opening, where the limiter is adjustable in at least two fixed positions for limiting the minimum distance from the side wall of the component box to the edge of the opening.

9 Claims, 3 Drawing Sheets

(56) References Cited

U.S. PATENT DOCUMENTS

| | | | | |
|---|---|---|---|---|
| 9,897,329 | B2 * | 2/2018 | Sosso | F24C 15/2042 |
| 2017/0198870 | A1 * | 7/2017 | Wu | F21V 29/767 |
| 2018/0058703 | A1 * | 3/2018 | Pickett | F24C 15/12 |

FOREIGN PATENT DOCUMENTS

| | | | | | |
|---|---|---|---|---|---|
| EP | 2602555 | A2 | | 6/2013 | |
| JP | S55105811 | U | * | 7/1980 | F24C 15/108 |
| JP | H0510906 | U | | 2/1993 | |
| JP | H0972553 | A | * | 3/1997 | F24C 15/108 |
| JP | S5223667 | U | * | 3/1997 | F24C 15/108 |
| JP | 2001304586 | A | | 10/2001 | |
| JP | 2013044440 | A | | 3/2013 | |

OTHER PUBLICATIONS

Japanese to English machine translation for JP_S5223667_U (Year: 1997).*

Japanese to English machine translation for JP_S55105811_U (Year: 1980).*

Japanese to English machine translation for JPH0972553A (Year: 1997).*

German to English machine translation for DE_102012200315_A1 (Year: 2013).*

German to English machine translation for DE_102007012481_A1 (Year: 2008).*

International Search Report PCT/EP2020/084415 dated Feb. 3, 2021.

* cited by examiner

COOKING PLATE AND A PROCEDURE FOR MOUNTING A COOKING PLATE

CROSS-REFERENCES TO RELATED APPLICATIONS

This application is the U.S. National Stage of International Application No. PCT/EP2020/084415, filed Dec. 3, 2020, which designated the United States and has been published as International Publication No. WO 2021/122027 A1 and which claims the priority of European Patent Application, Serial No. 19383149.2, filed Dec. 19, 2019, pursuant to 35 U.S.C. 119 (a)-(d).

The contents of International Application No. PCT/EP2020/084415 and European Patent Application, Serial No. 19383149.2 are incorporated herein by reference in their entireties as if fully set forth herein.

BACKGROUND OF THE INVENTION

The invention relates to the field of cooking plates mountable into an opening of a kitchen worktop, wherein the cooking plate comprises a component box for housing functional components of the cooking plate, which has a base and side walls, wherein at least one of the side walls is connected to a resting fin that can rest on the resting surface in a mounted state of the cooking plate in the opening, and a positioning device with at least a limiter limiting the minimum distance from the wall to an opening edge in the mounted state of the cooking plate in the opening.

From EP 2602555 B1, an arrangement of a cooking plate mounted in an opening of a kitchen worktop with a component box having side walls facing the opening edges of the kitchen worktop is known. In order to fix the cooktop to the opening of the kitchen worktop and centre it inside the same, the cooking plate has elastic spacing elements fixed to the side walls of the box and contacting the edges of the kitchen worktop in the mounted position of the cooking plate in the opening of the kitchen worktop, thereby exerting a force against them to fix the plate and centre it in the opening.

BRIEF SUMMARY OF THE INVENTION

The object of the invention consists in providing a cooking plate that can be installed into an opening of a kitchen worktop in an easier manner.

This object is achieved by a cooking plate mountable into an opening of a kitchen worktop, wherein the cooking plate comprises a component box for housing functional components of the cooking plate, which has a base and side walls, wherein at least one of the side walls is connected to a resting fin that can rest on the resting surface in a mounted state of the cooking plate in the opening, and a positioning device with at least a limiter limiting the minimum distance from the wall to an opening edge in the mounted state of the cooking plate in the opening, wherein the limiter is adjustable in at least two fixed positions for limiting the minimum distance from the side wall of the component box to the edge of the opening.

A "kitchen worktop" is understood to be the horizontal surface into which the cooking plate can be introduced, normally in a kitchen. The worktop is usually a sheet having a thickness sufficient to support the weight of what is going to be arranged on it, normally bigger than 2 cm and smaller than 10 cm. It can be made of wood, stone, laminated wood, synthetic materials of any material used to that effect into which a cut has been made to open the opening into which the kitchen plate is to be installed.

A "component box" is understood to be the volume containing the functional components of the appliance, such as burners, gas taps, gas-collecting pipes and an igniter in a gas cooking plate, or the electronics, ventilation and inductors in an induction cooking plate. The box can be of a metal and/or plastic sheet made in one or several pieces and comprises a base and side walls rising in a substantially perpendicular manner relative to the base. The at least one resting fin is connected to a side wall and, preferably, a resting fin extends from each side wall. In a preferred embodiment, the at least one resting fin is formed in one piece with the side wall or is fixed to it and extends from the top perimeter of the side wall in parallel to the resting surface, being able to rest on this surface when the cooking plate is mounted in the opening. The resting fins can be on a side wall or on several of the resting walls of the cooking plate. The resting fins are present preferably on all the side walls so they rest on the surface of the kitchen worktop and distribute in this manner the weight of the component box, or they are at least present on two opposite side walls.

The opening is usually rectangular like the base of the component box and has necessarily a bigger surface than that of the component box so that this can be fitted into the opening. In this manner, the cooking plate can be installed into an opening existing in the kitchen worktop of a bigger size than the component box and provided that at least two resting fins remain resting on the top surface of the kitchen worktop, preferably two opposite resting fins. That is to say, when a user replaces his/her cooking plate from the kitchen by one having a component box smaller than the previous one, it is of the user's interest to position it in the opening, normally centred in it while keeping the same distance from the side walls to the opening edge.

The positioning device of the kitchen plate is an element or set of elements acting to adjust the position of the cooking plate in the opening, in particular with respect to the opening edges. The positioning device consists at least of a limiter. A limiter is considered to be any element that can be used to limit the movement of the plate relative to the opening edge when it is mounted in the opening, blocking the movement of the plate towards the opening edge.

With this configuration of the invention, it is possible to install the cooking plate into an already existing worktop's opening having a bigger size than the component box of the plate and to block the movement of the component box of the cooking plate inside the opening.

To allow the limiter to comply with its spacing function with respect to the opening edge, it is preferred that the at least one limiter is arranged on the resting fin, since the resting fin rests on the surface of the kitchen worktop and is in contact with the edge.

In order to block the movement of the cooking plate in two directions in its position mounted in the opening, at least two limiters are provided limiting the minimum distance from at least two side walls of the component box to a respective edge of the opening.

In a simplified, resistant and low-cost construction, the material of the component box and of at least a resting fin is a sheet and is made in one piece of shaped sheet.

To make the plate's construction even simpler, the at least one limiter is made on the at least one resting fin.

In an embodiment of the invention, the at least one limiter is made as at least a flange arranged at the perimeter of the resting fin that can be folded downwards according to the direction of installation of the cooking plate, thereby fixing the minimum distance to the side wall of the component box. The flange is arranged preferably on the centre of the resting fin or, to give more stability, there can be two flanges arranged near the edges of the fin or there can be also a sole flange having a width slightly smaller than the width of the opening. The flange is folded once the size of the opening has been determined.

In another embodiment, the at least one limiter is made as at least two inner die-cutting points of the resting fin that can be folded downwards according to the direction of installation of the cooking plate, thereby fixing the minimum distance to the side wall of the component box. The die-cutting point is arranged preferably on the centre of the resting fin or, if there are two, spaced apart from one another towards the edge of the fin and at the same distance to the wall of the box. Both in this embodiment and the previous one, it is advantageous to have limiters on opposite fins of the box so as to limit the distance to opposite edges of the opening.

In another different embodiment, the at least one limiter is made as at least an additional piece that can be moved and blocked, thereby fixing the minimum distance to the side wall of the component box with the same aim as in the previous embodiments. This type of limiter can be an L-shaped piece that is guided over the resting fin with its long arm and whose short arm is contacted by the opening edge, thereby limiting the minimum distance to this.

For an adequate aesthetic and functional construction, the cooking plate has a top sheet that is mounted onto the component box and covers the at least one resting fin and can rest at least in part directly on the resting surface. This top sheet can be metallic or of tempered glass or ceramic glass usual in cooking plates. The heating zones are arranged on it. This top sheet covers the resting fins and the resting fins are in contact with the lower face of this top sheet, preferably joined to it. In the embodiment of the limiter as an additional piece, this can be connected to the lower face of this top sheet.

In an additional aspect of the invention, an installation process of a cooking plate according to the invention into an opening of a resting surface is proposed comprising the steps of determining the distance between opposite opening edges, adjusting the limiters at a desired distance, and mounting the cooking plate into the opening.

BRIEF DESCRIPTION OF THE DRAWINGS

The invention is described in the following taking the following figures as a reference.

DETAILED DESCRIPTION OF EXEMPLARY EMBODIMENTS OF THE PRESENT INVENTION

Figure 1:
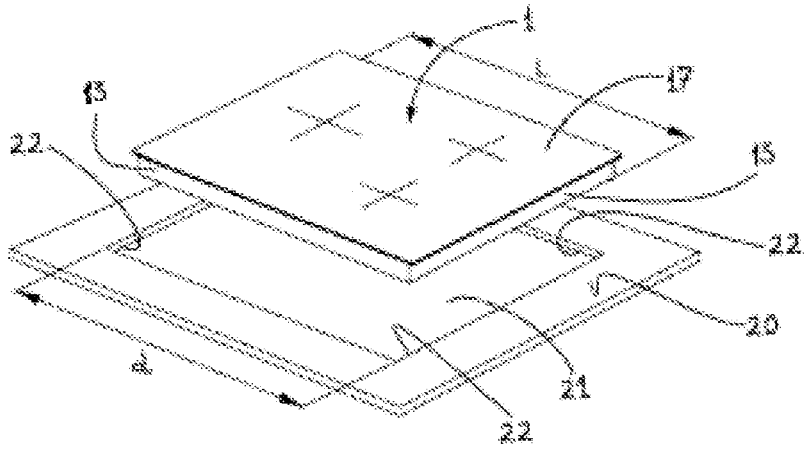
FIG. 1 shows a top perspective view of a kitchen plate in a pre-installation position over the kitchen worktop.
Figure 1A:
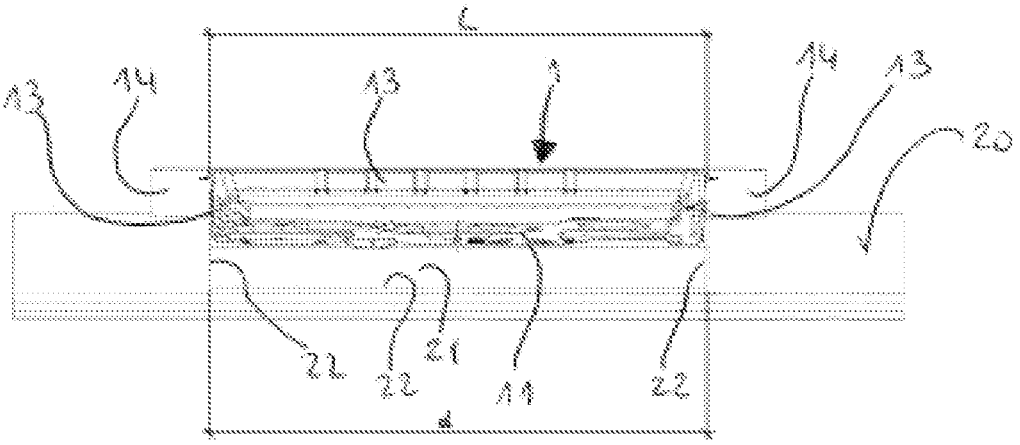
FIG. 1*a* shows a side view of a plate according to the invention facing an insertion opening of a kitchen worktop.
Figure 1B:
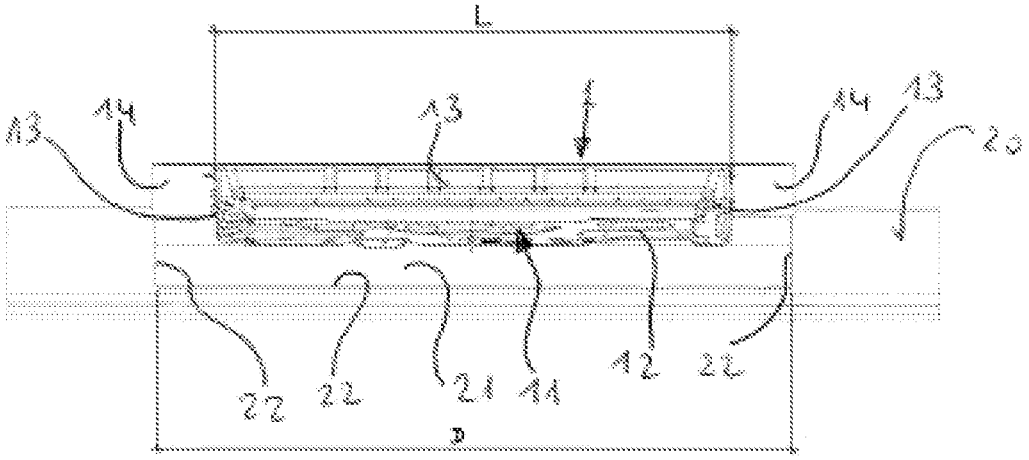
FIG. 1*b* shows a side view of a plate according to the invention facing an insertion opening of a kitchen worktop, FIG. 2*a* a detail of a resting fin with a configuration of the positioning element having three limiters at a different distance from the side of the base, FIG. 2*b* the resting fin of FIG. 2*a* with one of the limiters of the positioning element folded to limit the distance from the plate to the opening edge, FIG. 3 a view of a cooking plate according to another embodiment of the invention lying over the opening of the kitchen worktop, and FIG. 4 a bottom view of a kitchen worktop with a plate according to another embodiment of the invention mounted in the opening.

FIG. 1*a* and FIG. 1*b* show the cooking plate 1 of the invention in a pre-mounted position in the opening 21 over the kitchen worktop 20. The kitchen plate has a component box 11 with a base 12 and side walls 13. Resting fins 14 extend from the top perimeter of the side walls 13 and are provided to rest on the top surface of the kitchen worktop 20. The cooking plate 1 is provided to be installed into an opening 21 having a rectangular perimeter observed from above in the kitchen worktop 20. In this case, a resting fin 14 projects from each side wall 13 and can rest on the surface of the kitchen worktop 20 in its installation position.

The cooking plate 1 from FIGS. 1*a* and 1*b* is the same one and can be installed in kitchen worktops 20 with openings 21 of a different size. The distance between two of the opposite side walls 13 of the box 11 is "L". In FIG. 1*a*, the opening 21 has a rectangular shape and a distance "d" between two of its opposite edges 22 being slightly bigger than the distance "L", a difference amounting to 1 cm to 3 cm. In FIG. 1*b*, the distance between two of its opposite edges 22 is "D", significantly bigger than distance "L" and distance "d". The distance between the other two opposite edges 22 of the openings 21 from FIGS. 1*a* and 1*b* are substantially identical and slightly bigger than the distance between the other two side walls 13 of the component box 11. In particular, in FIG. 1*a*, the surface of the opening 21 is slightly bigger than the section surface of the component box 11 cut by the plane formed by the surface of the kitchen worktop 20 and, in FIG. 1*b*, the surface of the opening 21 is significantly bigger than the section surface of the component box 11 cut by the plane formed by the surface of the kitchen worktop 20. FIG. 1 shows in a top perspective view the kitchen plate from FIG. 1*a* with its top sheet 17 with its cooking zones, in a pre-installation position over the opening 21 of the kitchen worktop 20.

Figure 2A:
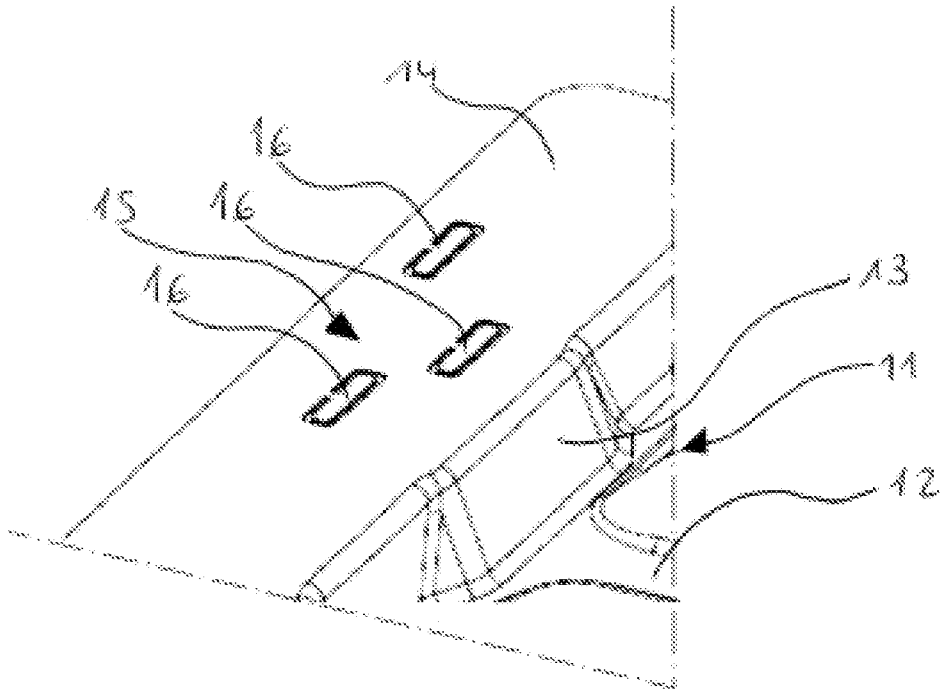
Figure 2B:
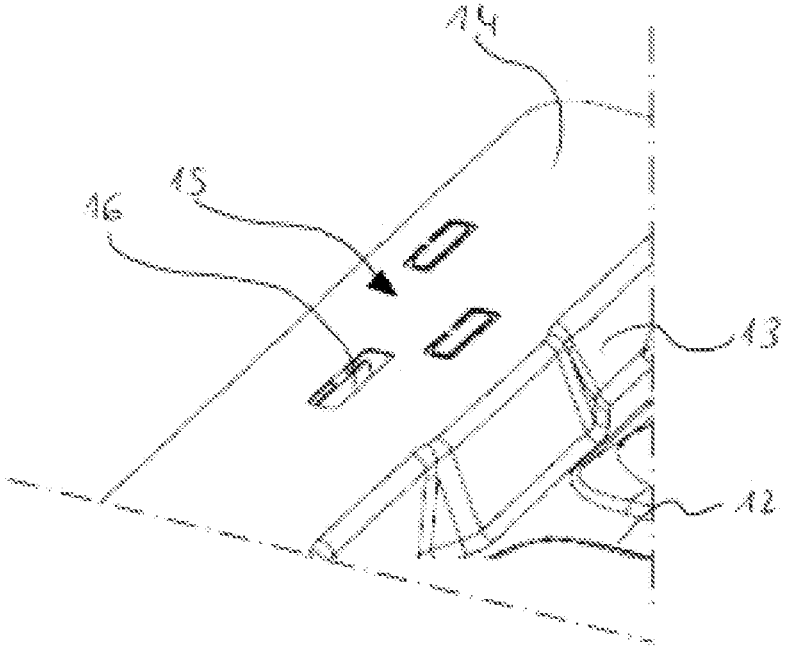

FIGS. 2*a* and 2*b* show in a detailed manner one of the resting fins 14 of the kitchen plate 1 having a positioning device 15 formed by three limiters 16 made in the form of die-cutting points inside the surface of the resting fin 14 arranged at a different distance to the side wall 13 of the component box 11. In FIG. 2*a*, limiters 16 in the form of die-cutting points are not folded. Therefore, virtually the entire resting fin 14 could rest in a plane manner on the surface of the kitchen worktop 20, the side wall 13 being adjacent to the edge 22 of the opening 21. In FIG. 2*b*, one of the die-cutting points 16 is folded down in the mounting direction of the plate 1. Therefore, when the kitchen plate is installed into the opening 21, the limiter 16 projecting downwards defines a minimum distance from the side wall 13 to the edge 22 of the opening 21. On a side spaced apart from the resting fin 14, there can be other limiters 16 (not shown) being part of the positioning device 15 to define even better the minimum distance from the side wall 13 to the edge 22. Furthermore, on the other side of the component box 11, there can be another resting fin 14 having more limiters 16 being part of the positioning device 15 to define the minimum distance from the opposite side wall 13 to the opposite side wall 13.

Figure 3:
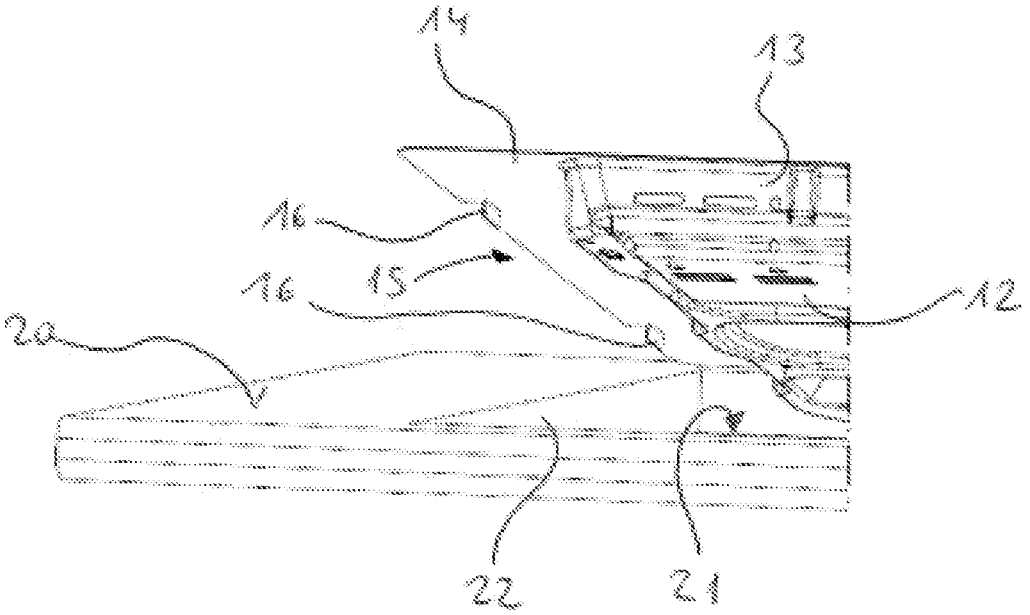

FIG. 3 shows another embodiment of the invention in which the limiters 16 of the positioning device 15 are made in a similar manner to those from FIGS. 2*a* and 2*b*. In this case, they are arranged on the perimeter of the resting fins 14 and can be folded downwards in the direction of installation of the cooking plate 1. In the figure, two limiters 16 are shown being arranged on one of the resting fins 14 spaced apart from one another to better define the minimum distance from the side wall 13 to the edge 22 of the opening 21. To reduce the distance from the side wall 13 to the edge 22, the limiters 16 can be folded at a distance closer to the side wall 13. As it has been explained in the previous embodiment, on the opposite resting fin 14 (not shown) there can be more limiters 16 than can be folded down to limit the minimum distance.

Figure 4:
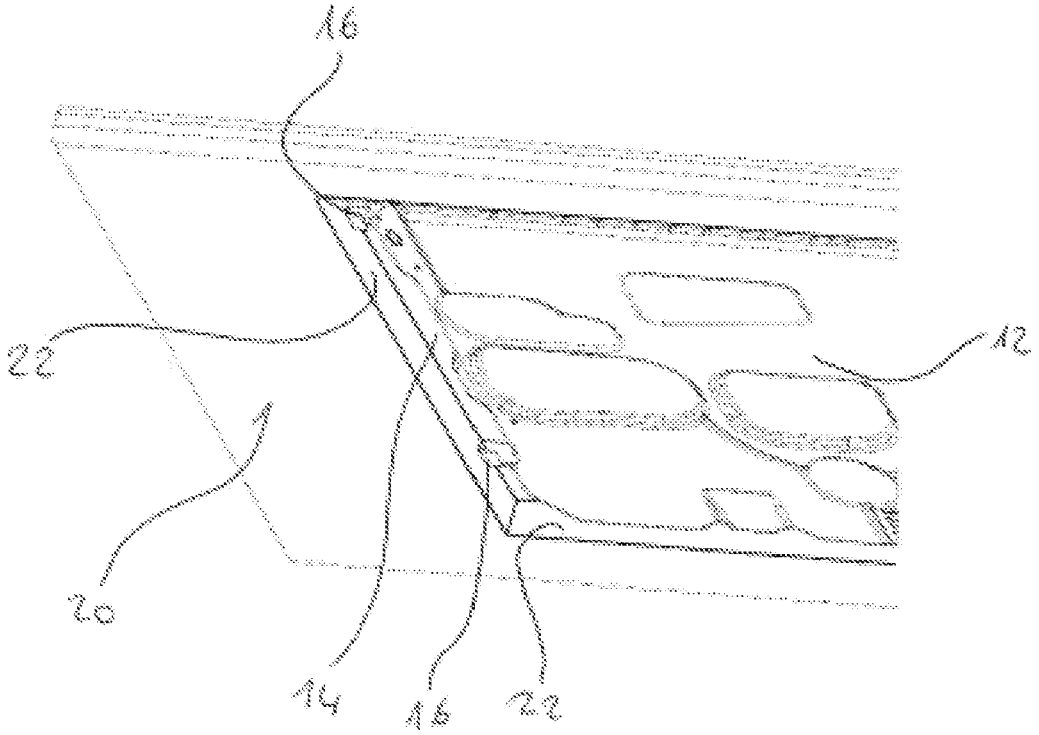

FIG. 4 shows another embodiment of the invention in which the limiters 16 of the positioning device 15 are made as additional pieces connected to the lower face of the resting fin 14 having relative movement. In the figure, two limiters 16 are shown being arranged on one of the resting fins 14 spaced apart from one another to better define the minimum distance from the side wall 13 to the edge 22 of the opening 21. To reduce or increase the distance from the side wall 13 to the edge 22, the ends of the limiters 16 are displaced and fixed at the desired distance from the side wall 13. As it has been explained in the previous embodiments, on the opposite resting fin 14 (not shown) there can be more limiters 16 identical to these ones or any one from those of the previous embodiments to limit the minimum distance.

That is to say, any of these types of limiters can be used on the same cooking plate, on the same resting fin or on opposite resting fins. There can be limiters on a resting fin or on the four resting fins, and they can be adjusted having different distances to the side walls in order to place the cooking plate relative to the opening in the most convenient manner for the installer.

All the installer of the cooking plate 1 needs to do is first measuring the distance "d" or "D" from the edges 22 of the opening 21, afterwards adjusting the limiters 16 at a distance from the side walls 13 of the component box 11, thereby fixing a minimum distance to each of the side walls 13 and, after that, installing the cooking plate 1 into the opening 21. If there is access under the kitchen worktop, the plate could also be installed into the opening to access the limiters afterwards and adjust them conveniently.

The invention claimed is:

1. A cooking plate mountable into an opening of a resting surface, said cooking plate comprising:

a functional component;

a component box configured to house the functional component and including a base and side walls, at least one of the side walls being connected to a resting fin capable of resting on the resting surface in a mounted state of the cooking plate in the opening; and a positioning device including a limiter limiting a minimum distance from the at least one of the side walls of the component box to an opening edge in the mounted state of the cooking plate in the opening, said limiter being configured to be foldable between a first fixed position in which the limiter is parallel to a surface of the resting surface in the mounted state and a second fixed position in which the limiter is substantially perpendicular to the surface of the resting surface in the mounted state, the limiter configured to adjustably limit the minimum distance from the at least one of the side walls of the component box to the opening edge of the opening.

2. The cooking plate of claim 1, constructed for mounting into an opening of a surface of a kitchen worktop.

3. The cooking plate of claim 1, wherein the limiter is arranged on the resting fin.

4. The cooking plate of claim 1, wherein the positioning device includes a further limiter limiting a minimum distance from another one of the side walls of the component box to an opening edge of the opening.

5. The cooking plate of claim 1, wherein the component box and the resting fin are made of a sheet material.

6. The cooking plate of claim 1, wherein the component box is integrally formed with the resting fin.

7. The cooking plate of claim 1, wherein the limiter is integrally formed on the resting fin.

8. The cooking plate of claim 1, wherein the limiter is formed by an inner die-cutting point of the resting fin, wherein the inner die-cutting point is configured to be foldable downwards according to a direction of installation of the cooking plate, thereby fixing the minimum distance.

9. The cooking plate of claim 1, further comprising a top sheet mounted onto the component box and covering the resting fin, said top sheet configured to rest at least in part directly on the resting surface.

* * * * *